US010542345B2

(12) United States Patent
Chiu et al.

(10) Patent No.: US 10,542,345 B2
(45) Date of Patent: Jan. 21, 2020

(54) VIRTUAL BASS GENERATING CIRCUIT AND METHOD

(71) Applicant: ELITE SEMICONDUCTOR MEMORY TECHNOLOGY INC., Hsinchu (TW)

(72) Inventors: Hsin-Yuan Chiu, Kaohsiung (TW); Tsung-Fu Lin, Tainan (TW)

(73) Assignee: ELITE SEMICONDUCTOR MEMORY TECHNOLOGY INC., Hsinchu (TW)

( * ) Notice: Subject to any disclaimer, the term of this patent is extended or adjusted under 35 U.S.C. 154(b) by 0 days.

(21) Appl. No.: 15/884,945

(22) Filed: Jan. 31, 2018

(65) Prior Publication Data

US 2019/0238979 A1 Aug. 1, 2019

(51) Int. Cl.
*H04R 3/04* (2006.01)
*H04R 1/22* (2006.01)

(52) U.S. Cl.
CPC ..... *H04R 3/04* (2013.01); *H04R 1/22* (2013.01); *H04S 2400/07* (2013.01)

(58) Field of Classification Search
CPC ..... H04R 3/04; H04R 1/22; H04S 2400/07
See application file for complete search history.

(56) References Cited

U.S. PATENT DOCUMENTS 8,582,784 B2 11/2013 Minnaar
8,693,706 B2 4/2014 Yokoyama
8,831,236 B2 9/2014 Yokoyama
2004/0071297 A1 4/2004 Katou et al.
2005/0245221 A1 11/2005 Beyer
2009/0052695 A1* 2/2009 Yamada ..... H03G 9/025 381/101
2009/0122998 A1* 5/2009 Poortere ..... H04R 1/2826 381/59
2010/0130149 A1* 5/2010 Zhang ..... H03G 3/344 455/222
2012/0259626 A1* 10/2012 Li ..... H04R 1/1083 704/226
2013/0177171 A1* 7/2013 Yokoyama ..... H04R 3/04 381/98
2016/0163334 A1 6/2016 Suzuki et al.

* cited by examiner

*Primary Examiner* — Sonia L Gay
(74) *Attorney, Agent, or Firm* — WPAT, PC

(57) ABSTRACT

A virtual bass generating circuit used in a speaker is used to filter out a high frequency part of an audio signal to generate a low passed audio signal, generates an even and odd audio signals respectively having even and odd harmonics of the low passed audio signal according to the low passed audio signal, subtracts an amplified low passed audio signal from an addition of an amplified even audio signal and an amplified odd audio signal to generate a first calculated audio signal, filters out a low frequency part and a high frequency part of the first calculated audio signal to generate a band passed audio signal, and adds the band passed audio signal and the audio signal to generate a second calculated audio signal with enhanced even and odd harmonics of the audio signal.

9 Claims, 4 Drawing Sheets

VIRTUAL BASS GENERATING CIRCUIT AND METHOD

FIELD OF THE INVENTION

The present disclosure relates to a speaker, in particular, to a virtual bass generating circuit and method used in the speaker.

BACKGROUND OF THE INVENTION

The speaker is used to convert the audio signal to the sound. The low frequency part of the audio signal may not be successfully converted by the speaker with general or poor performance, and that is, the speaker with general or poor performance cannot play the low frequency sound very well. Thus, the audio processing circuit in the speaker may filter out the low frequency part of the audio signal, but this causes the sound played by the speaker distort (i.e. the low frequency the sound cannot be listened by the user).

Referring to FIG. 1, FIG. 1 is a schematic diagram showing the psychoacoustic illusion. In FIG. 1, the actual signals of frequencies 2*f*, 3*f* and 4*f* are physically present, and the perceived bass signal of the lowest fundamental frequency f is virtually listened by the user, even if the perceived bass signal of the lowest fundamental frequency f is not physical present.

The psychoacoustic illusion can be used to generate the perceived bass signal for the speaker with the general or poor performance. The nonlinear device can be used to generate harmonics in series of the lowest fundamental frequency associated with the perceived bass signal. For example, the full wave rectifier can be used to generate the even harmonics, the soft clipping circuit can be used to generate the odd harmonics, and the circuit with the full wave rectifier and the integrator can be used to generate both of the even and odd harmonics.

Referring to FIG. 2, FIG. 2 is a schematic diagram showing a conventional virtual bass generating circuit. The conventional virtual bass generating circuit is used in the speaker. The conventional virtual bass generating circuit comprises a first-order high pass filter 10, a first-order low pass filter 12, an absolute value circuit 14, a second-order high pass filter 16, amplifiers 18, 28, 30, an adder 20, a second-order low pass filter 22, a clip circuit 24 and subtractors 26, 32.

An input end of the conventional virtual bass generating circuit is electrically connected to the subtractor 32 and the first high pass filter 10. The first high pass filter 10 is electrically connected the first low pass filter 12. The first low pass filter 12 is electrically connected to the absolute value circuit 14, the clip circuit 24 and the amplifier 30. The clip circuit 24 and the amplifier 30 are electrically connected to the subtractor 26, and the subtractor 26 is electrically connected to the amplifier 28. The absolute value circuit 14 is electrically connected to the second-order high pass filter 16, and the second-order high pass filter 16 is electrically connected to the amplifier 18. The amplifiers 18 and 28 are electrically connected to the adder 20, and the adder 20 is electrically connected to the second-order low pass filter 22. The second-order low pass filter 22 is electrically connected to the subtractor 32, and the subtractor 32 is electrically connected an output end of the conventional virtual bass generating circuit.

An audio signal is received by the input end of the conventional virtual bass generating circuit. The first high pass filter 10 and the first low pass filter 12 respectively filter out the low frequency part and the high frequency part of the audio signal to generate a first filtered audio signal. The absolute value circuit 14 obtains the absolute part of the first filtered audio signal, and functions as the full wave rectifier, so as to output the rectified audio signal. The second-order high pass filter 16 filters out the low frequency part of the rectified audio signal to generate a second filtered audio signal. The amplifier 18 amplifies the second filtered audio signal with the gain G1 to generate a first amplified audio signal.

The clip circuit 24 is used to clip the first filtered audio signal to generate a clipped audio signal, and the amplifier 30 amplifies the first filtered audio signal with the gain G3 to generate a third amplified audio signal. The subtractor 26 subtracts the third amplified audio signal from the clipped audio signal to generate a first subtracting audio signal. The amplifier 28 amplifies the first subtracting audio signal with the gain G2 to generate a second amplified audio signal.

The adder 20 adds the first amplified audio signal and the second amplified audio signal to generate an adding audio signal. The second low pass filter 22 filters out the high frequency part of the adding audio signal to generate a third filtered audio signal. The subtractor 32 subtracts the third filtered audio signal from the audio signal to generate a second subtracting audio signal. The conventional virtual bass generating circuit outputs the second subtracting audio signal which is played by the speaker. It is noted that that the first and second high pass filters 10 and 16 can prevent the direct current part of the audio signal from being played by the speaker. However, the conventional virtual bass generating circuit still needs four filters (i.e. 10, 12, 16 and 22), thus result high hardware cost.

SUMMARY OF THE INVENTION

An exemplary embodiment of the present disclosure provides a virtual bass generating circuit, comprising: a low pass filter, filtering out a high frequency part of an audio signal to generate a low passed audio signal; a harmonic generating circuit, electrically connected to the low pass filter, receiving the low passed audio signal, generating an even and odd audio signals respectively having even and odd harmonics of the low passed audio signal, and subtracting an amplified low passed audio signal from an addition of an amplified even audio signal and an amplified odd audio signal to generate a first calculated audio signal; a band pass filter, electrically connected to the harmonic generating circuit, filtering out a low frequency part and a high frequency part of the first calculated audio signal to generate a band passed audio signal; and a first adder, electrically connected to the band pass filter, adding the band passed audio signal and the audio signal to generate a second calculated audio signal with enhanced even and odd harmonics of the audio signal; wherein the even audio signal, the odd audio signal and the low passed audio signal are amplified with a first through third gains to generate the amplified even audio signal, the amplified odd audio signal and the amplified low passed audio signal; and wherein the second gain is determined according to the harmonic generating circuit and the third gain, such that a magnitude of the amplified low passed audio signal is equal to a magnitude of a first harmonic of the amplified odd audio signal.

An exemplary embodiment of the present disclosure provides a speaker comprising: a speaker assembly; and the above virtual bass generating circuit, electrically connected to the speaker assembly.

An exemplary embodiment of the present disclosure provides a method for generating a virtual bass of an audio signal, comprising: filtering out a high frequency part of the audio signal to generate a low passed audio signal; generating an even and odd audio signals respectively having even and odd harmonics of the low passed audio signal; subtracting an amplified low passed audio signal from an addition of an amplified even audio signal and an amplified odd audio signal to generate a first calculated audio signal; filtering out a low frequency part and a high frequency part of the first calculated audio signal to generate a band passed audio signal; and adding the band passed audio signal and the audio signal to generate a second calculated audio signal with enhanced even and odd harmonics of the audio signal; wherein the even audio signal, the odd audio signal and the low passed audio signal are amplified with a first through third gains to generate the amplified even audio signal, the amplified odd audio signal and the amplified low passed audio signal; and wherein the second gain is determined according to the generation of the odd audio signal and the third gain, such that a magnitude of the amplified low passed audio signal is equal to a magnitude of a first harmonic of the amplified odd audio signal.

To sum up, the provided virtual bass generating circuit, speaker and the method can enhance the even and odd frequency parts of the audio signal, and thus the user may feel that the base frequency of the audio signal is enhanced due to psychoacoustic illusion.

In order to further understand the techniques, means and effects of the present disclosure, the following detailed descriptions and appended drawings are hereby referred, such that, through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DETAILED DESCRIPTION OF THE PREFERRED EMBODIMENTS

Figure 1:
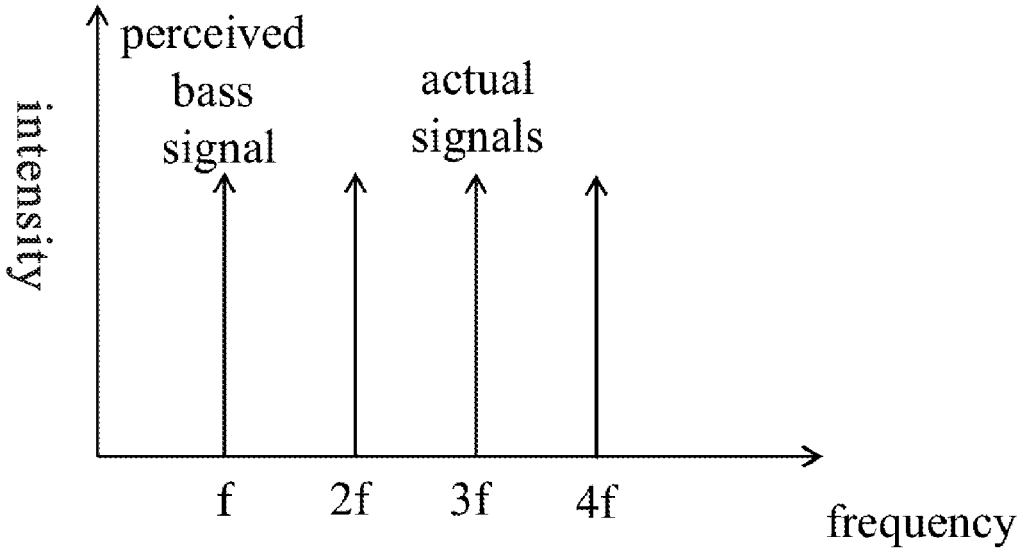
FIG. 1 (RELATED ART)
FIG. 1 is a schematic diagram showing the psychoacoustic illusion.
Figure 2:
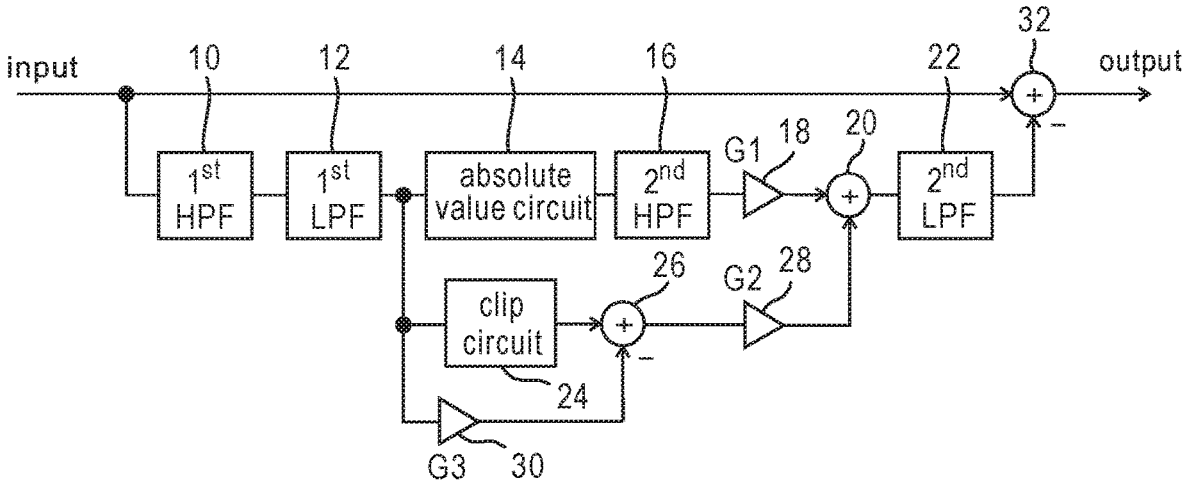
FIG.2(RELATED ART)
FIG. 2 is a schematic diagram showing a conventional virtual bass generating circuit.

Reference will now be made in detail to the exemplary embodiments of the present disclosure, examples of which are illustrated in the accompanying drawings. Wherever possible, the same reference numbers are used in the drawings and the description to refer to the same or like parts.

An exemplary embodiment of the present disclosure provides a virtual bass generating circuit used in a speaker. The audio signal is input into the virtual bass generating circuit, and then processed by the virtual bass generating circuit to filter out the high frequency part of the audio signal, to generate a low passed audio signal. Next, the low passed audio signal is processed by the virtual bass generating circuit to generate an even audio signal and an odd audio signal, wherein the even and odd audio signals respectively have even harmonics and odd harmonics.

In the virtual bass generating circuit, the even audio signal, the odd audio signal, and the low passed audio signals are respectively amplified with a first gain, a second gain and a third gain, and then the amplified even and odd signals are added and subtracted with the amplified low passed audio signal to generate a first calculated audio signal. Then, the first calculated audio signal is processed by the virtual bass generating circuit to filter out the high and low frequency parts thereof to generate a band passed audio signal, and then the virtual bass generating circuit adds the band passed audio signal and the audio signal to generate a second calculated audio signal to a speaker assembly of the speaker.

Figure 3:
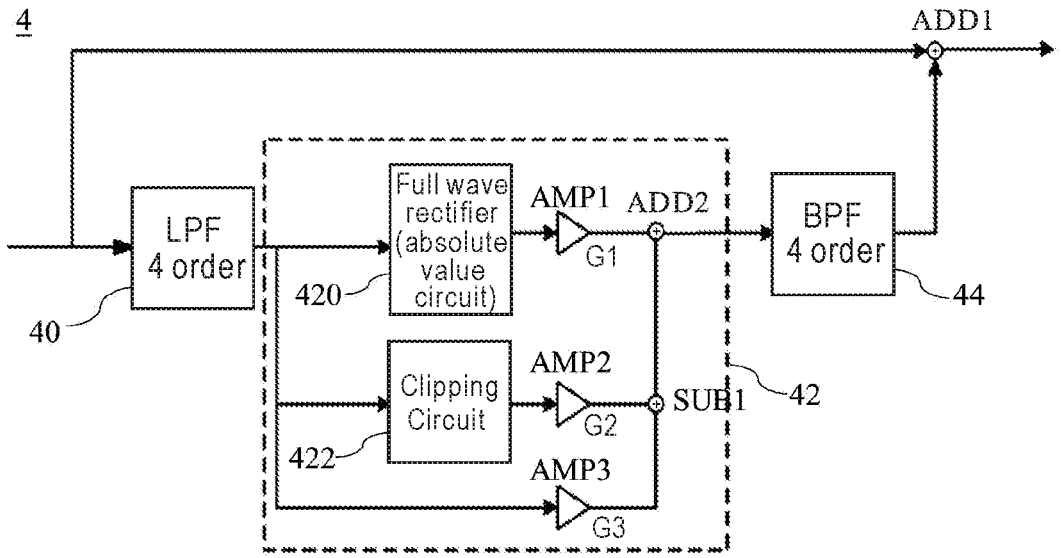
FIG. 3 is a schematic diagram of a virtual bass generating circuit according to an exemplary embodiment of the present disclosure.

Referring to FIG. 3, FIG. 3 is a schematic diagram of a virtual bass generating circuit according to an exemplary embodiment of the present disclosure. The virtual bass generating circuit 4 can be used in the speaker, and comprises a low pass filter 40, a harmonic generating circuit 42, a band pass filter 44 and an adder ADD1. The adder ADD1 is electrically connected to the band pass filter 44, and the harmonic generating circuit 42 is electrically connected to the low pass filter 40 and the band pass filter 44.

The virtual bass generating circuit 4 receives an audio signal. The low pass filter 40 filters out the high frequency part of the audio signal to generate a low passed audio signal. The low pass filter 40 can be a fourth order infinite impulse response (IIR) low pass filter, and the present disclosure is not limited thereto.

The harmonic generating circuit 42 receives the low passed audio signal to generate even and odd audio signals respectively having even harmonics and odd harmonics of the low passed audio signal. The harmonic generating circuit 42 further adds the amplified even and odd audio signals and subtracts the amplified low passed audio signal from the addition of the amplified even and odd audio signals, so as to generate a first calculated audio signal.

Next, the band pass filter 44 receives the first calculated audio signal and filters out the low and high frequency parts of the first calculated audio signal to generate a band passed audio signal. It is noted that the band pass filter 44 can be a fourth order IIR band pass filter, and the present disclosure is not limited thereto.

The adder ADD1 adds the band passed audio signal and the audio signal to generate a second calculated audio signal to the speaker assembly of the speaker. It is noted that the second calculated audio signal has enhanced even and odd harmonics of the low passed audio signal, and thus the user may feel that the base frequency of the audio signal is enhanced due to psychoacoustic illusion. Furthermore, compared with the prior art, the number of the required filters is reduced, such that the manufacturing cost is lowered.

The harmonic generating circuit 42 can implemented by the structure configuration as follows, and the present disclosure is not limited thereto. The harmonic generating circuit 42 comprises a full wave rectifier 420 (i.e. absolute value circuit) and a clipping circuit 422, amplifiers AMP1 through AMP3, an adder ADD2 and a subtractor SUB 1. The amplifier AMP1 is electrically connected to the full wave rectifier 420 and the adder ADD2. The amplifier AMP2 is electrically connected to the clipping circuit 422 and the subtractor SUB1. The subtractor SUB1 is electrically connected to the amplifier AMP3 and the adder ADD2.

The full wave rectifier 420 receives the low passed audio signal and rectifies the low passed audio signal (i.e. obtaining the absolute value of the low passed audio signal) to generate the even audio signal having even harmonics of the low passed audio signal. The clipping circuit 422 is used to clip the low passed audio signal to generate the odd audio signal having odd harmonics of the low passed audio signal. The amplifiers AMP1 through AMP3 are respectively used to amplify the even audio signal, the odd audio signal and the low passed audio signal with a first gain G1, a second gain G2 and a third gain G33, so as to generate the amplified even audio signal, the amplified odd audio signal and the amplified low passed signal.

The subtractor SUB1 subtracts the amplified odd audio signal with the amplified low passed signal0; and the adder ADD2 adds the amplified even audio signal and the subtracted result, so as to generate the first calculated audio signal. It is noted that the odd audio signal is amplified and then subtracted with the amplified low passed audio signal, such that it eases the gain adjustment of the amplifiers AMP2 and AMP3.

Figure 4:
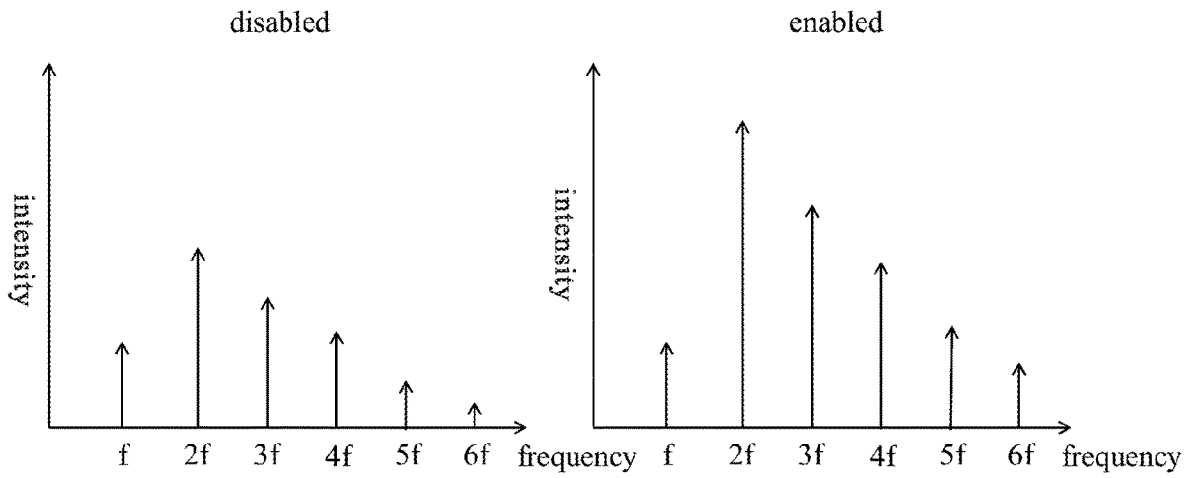
FIG. 4 is a schematic diagram showing the audio signal processed by the virtual bass generating circuit according to the exemplary embodiment of the present disclosure.

Next, referring to FIG. 4, FIG. 4 is a schematic diagram showing the audio signal processed by the virtual bass generating circuit according to the exemplary embodiment of the present disclosure. The frequency spectrum of the audio signal not processed by the virtual bass generating circuit (i.e. the virtual bass generating circuit of the speaker is disabled) is shown in the left, and the frequency spectrum of the audio signal processed by the virtual bass generating circuit (i.e. the virtual bass generating circuit of the speaker is enabled) is shown in the right. It is obvious that the intensities of the base frequency of these two audio signals are the same, but the intensities of the even and odd harmonics of the audio signal being processed are larger than those of the even and odd harmonics of the audio signal not processed. Thus, the user may feel that the base frequency of the audio signal is enhanced due to psychoacoustic illusion.

Furthermore, another one exemplary embodiment of the present disclosure discloses a speaker comprising the speaker assembly and the virtual bass generating circuit, wherein the speaker is electrically connected to the virtual bass generating circuit to receive the second calculated audio signal, so as to play the second calculated audio signal. It is noted that the second calculated audio signal has enhanced even and odd harmonics of the audio signal, and thus the user may feel that the base frequency of the audio signal is enhanced due to psychoacoustic illusion.

Moreover, another one exemplary embodiment of the present disclosure discloses a method for generating the virtual bass of the audio signal used in the speaker. Steps of the method are illustrated as follows. Firstly, an audio signal is processed to filter out the frequency part thereof to generate the low passed audio signal. Secondly, the low passed audio signal is processed to generate the even audio signal and the odd audio signal, wherein the even and odd audio signals respectively have even harmonics and odd harmonics. Thirdly, the amplified even and odd audio signals are added and subtracted with the amplified low passed audio signal to generate the first calculated audio signal. Fourthly, the first calculated audio signal is processed to filter out the low and high frequency parts thereof to generate the band passed audio signal. Finally, the band passed audio signal and the audio signal are added to generate the second calculated audio signal to the speaker assembly of the speaker.

Accordingly, in the exemplary embodiments of the present disclosure, the provided virtual bass generating circuit, speaker and the method can enhance the even and odd frequency parts of the audio signal, and thus the user may feel that the base frequency of the audio signal is enhanced due to psychoacoustic illusion. Furthermore, compared with the prior art, the number of the required filters can be reduced so as to lower the manufacturing cost. Moreover, the odd audio signal is amplified and then subtracted with the amplified low passed audio signal, such that it eases the gain adjustment of the amplifiers.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A virtual bass generating circuit, comprising:

a low pass filter, filtering out a high frequency part of an audio signal to generate a low passed audio signal;

a harmonic generating circuit, electrically connected to the low pass filter, receiving the low passed audio signal, generating an even and odd audio signals respectively having even and odd harmonics of the low passed audio signal, and subtracting an amplified low passed audio signal from an addition of an amplified even audio signal and an amplified odd audio signal to generate a first calculated audio signal;

a band pass filter, electrically connected to the harmonic generating circuit, filtering out a low frequency part and a high frequency part of the first calculated audio signal to generate a band passed audio signal; and a first adder, electrically connected to the band pass filter, adding the band passed audio signal and the audio signal to generate a second calculated audio signal with enhanced even and odd harmonics of the audio signal;

wherein the even audio signal, the odd audio signal and the low passed audio signal are amplified with a first through third gains to generate the amplified even audio signal, the amplified odd audio signal and the amplified low passed audio signal; and wherein the second gain is determined according to the harmonic generating circuit and the third gain, such that a magnitude of the amplified low passed audio signal is equal to a magnitude of a first harmonic of the amplified odd audio signal.

2. The virtual bass generating circuit according to claim 1, wherein the low pass filter is a fourth order infinite impulse response low pass filter.

3. The virtual bass generating circuit according to claim 1, wherein the band pass filter is a fourth order infinite impulse response band pass filter.

4. The virtual bass generating circuit according to claim 1, wherein the harmonic generating circuit comprises:

a full wave rectifier, electrically connected to the low pass filter, receiving the low passed audio signal to generate the even audio signal;

a clipping circuit, electrically connected to the low pass filter, receiving the low passed audio signal to generate the odd audio signal a first amplifier, electrically connected to the low pass filter, amplifying the low passed audio signal to generate the amplified low passed audio signal;

a second amplifier, electrically connected to the clipping circuit, amplifying the odd audio signal to generate the amplified odd audio signal;

a third amplifier, electrically connected to the full wave rectifier, amplifying the even audio signal to generate the amplified even audio signal;

a subtractor, electrically connected to the first and second amplifiers, subtracting the amplified low passed audio signal from the amplified odd audio signal; and a second adder, electrically connected to the subtractor and the third amplifier, adding the amplified even audio signal and a subtraction result of the amplified low passed audio signal and the amplified odd audio signal, so as to generate the first calculated audio signal.

5. A speaker, comprising:

a virtual bass generating circuit; and a speaker assembly, electrically connected to the virtual bass generating circuit;

wherein the virtual bass generating circuit comprises:

a low pass filter, filtering out a high frequency part of an audio signal to generate a low passed audio signal;

a harmonic generating circuit, electrically connected to the low pass filter, receiving the low passed audio signal, generating an even and odd audio signals respectively having even and odd harmonics of the low passed audio signal, and subtracting an amplified low passed audio signal from an addition of an amplified even audio signal and an amplified odd audio signal to generate a first calculated audio signal;

a band pass filter, electrically connected to the harmonic generating circuit, filtering out a low frequency part and a high frequency part of the first calculated audio signal to generate a band passed audio signal; and a first adder, electrically connected to the band pass filter, adding the band passed audio signal and the audio signal to generate a second calculated audio signal with enhanced even and odd harmonics of the audio signal;

wherein the even audio signal, the odd audio signal and the low passed audio signal with are amplified with a first through third gains to generate the amplified even audio signal, the amplified odd audio signal and the amplified low passed audio signal; and wherein the second gain is determined according to the harmonic generating circuit and the third gain, such that a magnitude of the amplified low passed audio signal is equal to a magnitude of a first harmonic of the amplified odd audio signal.

6. The speaker according to claim 5, wherein the low pass filter is a fourth order infinite impulse response low pass filter.

7. The speaker according to claim 5, wherein the band pass filter is a fourth order infinite impulse response band pass filter.

8. The speaker according to claim 5, wherein the harmonic generating circuit comprises:

a full wave rectifier, electrically connected to the low pass filter, receiving the low passed audio signal to generate the even audio signal;

a clipping circuit, electrically connected to the low pass filter, receiving the low passed audio signal to generate the odd audio signal a first amplifier, electrically connected to the low pass filter, amplifying the low passed audio signal to generate the amplified low passed audio signal;

a second amplifier, electrically connected to the clipping circuit, amplifying the odd audio signal to generate the amplified odd audio signal;

a third amplifier, electrically connected to the full wave rectifier, amplifying the even audio signal to generate the amplified even audio signal;

a subtractor, electrically connected to the first and second amplifiers, subtracting the amplified low passed audio signal from the amplified odd audio signal; and a second adder, electrically connected to the subtractor and the third amplifier, adding the amplified even audio signal and a subtraction result of the amplified low passed audio signal and the amplified odd audio signal, so as to generate the first calculated audio signal.

9. A method for generating a virtual bass of an audio signal, comprising:

filtering out a high frequency part of the audio signal to generate a low passed audio signal;

generating an even and odd audio signals respectively having even and odd harmonics of the low passed audio signal;

subtracting an amplified low passed audio signal from an addition of an amplified even audio signal and an amplified odd audio signal to generate a first calculated audio signal;

filtering out a low frequency part and a high frequency part of the first calculated audio signal to generate a band passed audio signal; and adding the band passed audio signal and the audio signal to generate a second calculated audio signal with enhanced even and odd harmonics of the audio signal;

wherein the even audio signal, the odd audio signal and the low passed audio signal are amplified with a first through third gains to generate the amplified even audio signal, the amplified odd audio signal and the amplified low passed audio signal; and wherein the second gain is determined according to the generation of the odd audio signal and the third gain, such that a magnitude of the amplified low passed audio signal is equal to a magnitude of a first harmonic of the amplified odd audio signal.

* * * * *